US007994879B2

(12) United States Patent
Kim et al.

(10) Patent No.: US 7,994,879 B2
(45) Date of Patent: Aug. 9, 2011

(54) APPARATUS FOR TRANSITIONING MILLIMETER WAVE BETWEEN DIELECTRIC WAVEGUIDE AND TRANSMISSION LINE

(75) Inventors: Bong-Su Kim, Daejon (KR); Woo-Jin Byun, Daejon (KR); Kwang-Seon Kim, Daejon (KR); Myung-Sun Song, Daejon (KR)

(73) Assignee: Electronics and Telecommunication Research Institute, Daejon (KR)

( * ) Notice: Subject to any disclaimer, the term of this patent is extended or adjusted under 35 U.S.C. 154(b) by 208 days.

(21) Appl. No.: 12/515,245

(22) PCT Filed: Oct. 30, 2007

(86) PCT No.: PCT/KR2007/005367

§ 371 (c)(1),
(2), (4) Date: May 15, 2009

(87) PCT Pub. No.: WO2008/060047

PCT Pub. Date: May 22, 2008

(65) Prior Publication Data

US 2010/0253450 A1 Oct. 7, 2010

(30) Foreign Application Priority Data

Nov. 17, 2006 (KR) ..... 10-2006-0114045
Aug. 6, 2007 (KR) ..... 10-2007-0078569

(51) Int. Cl.
*H01P 1/20* (2006.01)

(52) U.S. Cl. ..... 333/202; 333/26; 333/230; 333/254; 333/212

(58) Field of Classification Search ..... 333/202, 333/26, 246, 230, 254, 260, 212, 208, 227, 333/248

See application file for complete search history.

(56) References Cited

U.S. PATENT DOCUMENTS 5,471,181 A 11/1995 Park (Continued)

FOREIGN PATENT DOCUMENTS

EP 1 592 081 A1 11/2005

(Continued)

OTHER PUBLICATIONS

Rosine Valois, et al., "LTCC technology for 40 GHz bandpass waveguide filter," 2005 IEEE MTT-S International Microwave Symposium Digest, Publication Date: Jun. 12-17, 2005 (4 pages).

(Continued)

*Primary Examiner* — Stephen E Jones
(74) *Attorney, Agent, or Firm* — Staas & Halsey LLP

(57) ABSTRACT

Provided is an apparatus for transitioning a millimeter wave between dielectric waveguide and transmission line using a millimeter wave transition structure formed by the dielectric waveguide, the transmission line, and a slot to transition a signal with lower losses. The apparatus includes: transmission lines disposed respectively at input and output terminals on an uppermost dielectric substrate in a signal transition direction and adapted to transition a signal; a dielectric waveguide formed by a via array disposed between top and bottom ground surfaces of a lowermost dielectric substrate in the signal transition direction as a signal transition path; and slots disposed at a signal transition path of an upper ground surface of each dielectric substrate to connect the transmission lines to the dielectric waveguide so as to transition a signal from the transmission line of the input terminal to the transmission line of the output terminal through the dielectric waveguide.

9 Claims, 4 Drawing Sheets

U.S. PATENT DOCUMENTS

| | | | | |
|---|---|---|---|---|
| 5,821,836 | A | 10/1998 | Katehi et al. | |
| 6,362,706 | B1 * | 3/2002 | Song et al. | 333/219 |
| 6,498,550 | B1 * | 12/2002 | Miller et al. | 333/208 |
| 6,509,809 | B1 | 1/2003 | Lynch | |
| 7,192,882 | B2 * | 3/2007 | Bergstedt et al. | 438/745 |
| 2006/0091971 | A1 | 5/2006 | Tahara et al. | |

FOREIGN PATENT DOCUMENTS

| | | |
|---|---|---|
| JP | 9-246816 | 9/1997 |
| JP | 2002-208807 | 7/2002 |
| KR | 10-2004-0072379 | 8/2004 |
| KR | 10-2005-0059764 | 6/2005 |
| KR | 10-0576552 B1 | 4/2006 |
| KR | 10-0651627 B1 | 11/2006 |

OTHER PUBLICATIONS

International Search Report mailed on Jan. 29, 2008 in connection with International Application No. PCT/KR2007/005367.

* cited by examiner

APPARATUS FOR TRANSITIONING MILLIMETER WAVE BETWEEN DIELECTRIC WAVEGUIDE AND TRANSMISSION LINE

CROSS REFERENCE TO RELATED APPLICATIONS

This application claims the benefit under 35 U.S.C. Section 371, of PCT International Application PCT/KR2007/005367 filed Oct. 30, 2007, which claimed priority to Korean Application 10-2006-0114045 filed Nov. 17, 2006, and Korean Application 10-2007-0078569 filed Aug. 6, 2007 in the Korean Intellectual Property Office, the disclosures of all of which are hereby incorporated by reference.

TECHNICAL FIELD

The present invention relates to an apparatus for transitioning a millimeter wave between a dielectric waveguide and a transmission line; and, more particularly, to an apparatus for transitioning a millimeter wave between a dielectric waveguide and a transmission line using a millimeter wave transition structure formed by the dielectric waveguide, the transmission line, and a slot so as to transition a signal with lower losses.

This work was supported by the Information Technology (IT) research and development program of the Korean Ministry of Information and Communication (MIC) and/or the Korean Institute for Information Technology Advancement (IITA) [2005-S-046-02, "Development of the basic spectrum resource utilizing technology"].

BACKGROUND ART

Mobile communication service providers provide voice call and text message services based on second-generation (2G) communication services, and provide transmission of image information based on third-generation (3G) communication services. Furthermore, many researches have been conducted on fourth-generation (4G) communication services to transmit data at a data rate of 100 Mbps or higher. To provide wide-bandwidth and high-speed communication of 4 G communication service, mobile communication service providers conduct many researches on millimeter-wave communication technology.

Communication systems using millimeter waves are used in various application fields. For example, the millimeter-wave communication systems are used for fixed wireless network access systems, transmission between base stations in mobile communication systems, vehicle anti-collision radar systems, and intelligent transport systems (ITS), including outdoor communication systems. Furthermore, the use of the millimeter-wave communication systems may extend to various fields requiring a transmission rate of 100 Mbps or higher.

However, since such millimeter-wave communication systems are fabricated by assembling separate components, the millimeter-wave communication systems are large in size and expensive. Therefore, it is difficult to use the millimeter-wave communication systems for general purposes. For this reason, packaging technology using multiple substrates is actively studied to reduce the size and price of the millimeter-wave communication systems.

Particularly, system in a package (SIP) technology using low temperature co-fired ceramic (LTCC) has developed for various systems such as point-to-multipoint transceivers having an operating bandwidth of about 26 GHz or short-range wireless communication systems having an operating bandwidth of about 60 GHz to 72 GHz.

The millimeter-wave communication systems use various types of millimeter-wave transition apparatuses to reduce transition losses between components. For example, a millimeter-wave transition apparatus in a millimeter-wave communication system for transitioning a millimeter wave between a waveguide and a transmission line.

Hereinafter, a millimeter-wave transition apparatus of the related art will be described with reference to FIGS. 1 and 2. FIG. 1 is a plan view illustrating an apparatus for transitioning a millimeter wave between a standard waveguide and a transmission line according to the related art, and FIG. 2 is a cross-sectional view of the millimeter-wave transition apparatus of FIG. 1.

Referring to FIGS. 1 and 2, the millimeter-wave transition apparatus of the related art includes a standard waveguide 110, a slot 120, and a microstrip 130.

The standard waveguide 110 and the microstrip 130 are connected through the slot 120 so that a signal can transition between the standard waveguide 110 and the microstrip 130. An end of the standard waveguide 110 is stepped or curved for impedance matching.

The standard waveguide 110 has a stepped end as explained above, and the performance of the millimeter-wave transition apparatus is affected by the height and width of the stepped end. However, it is difficult to design and fabricate the stepped end of the standard waveguide 110. That is, in the related art, the shape of the standard waveguide 110 of the millimeter-wave transition apparatus is obtained by varying that of a standard waveguide. As a result, losses increase due to the complicated structure of the standard waveguide 110, and the performance of the millimeter-wave transition apparatus is sensitive to manufacturing errors.

Therefore, what is needed is an efficient millimeter-wave transition structure that can be fabricated without varying the shape of a standard waveguide so as to reduce design and manufacturing times and realize operations less sensitive to manufacturing errors.

DISCLOSURE

Technical Problem

An embodiment of the present invention is directed to providing an apparatus for transitioning a millimeter wave between a dielectric waveguide and a transmission line using a millimeter wave transition structure formed by the dielectric waveguide, the transmission line, and a slot so as to transition a signal with lower losses.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided an apparatus for transitioning a millimeter wave, which includes: transmission lines disposed respectively at input and output terminals on an uppermost dielectric substrate in a signal transition direction and adapted to transition a signal; a dielectric waveguide formed by a via array disposed between top and bottom ground surfaces of a lowermost dielectric substrate in the signal transition direction as a signal transition path; and slots disposed at a signal transition path of an upper ground surface of each dielectric substrate to connect the transmission lines to the dielectric waveguide so as to transition a signal from the transmission line of the input terminal to the transmission line of the output terminal through the dielectric waveguide.

ADVANTAGEOUS EFFECTS

In accordance with embodiments of the present invention, a millimeter-wave transition structure can be easily provided using a dielectric waveguide, a transmission line, and a slot formed at a dielectric substrate.

Furthermore, the millimeter-wave transition apparatus of the present invention can be designed with less time and fabricated with fewer errors.

In addition, since the millimeter-wave transition apparatus can be simply designed and fabricated, transition losses can be reduced so that the millimeter-wave transition apparatus can have a higher performance.

BEST MODE FOR THE INVENTION

The advantages, features and aspects of the invention will become apparent from the following description of the embodiments with reference to the accompanying drawings, which is set forth hereinafter. Therefore, those skilled in the field of this art of the present invention can embody the technological concept and scope of the invention easily. In addition, if it is considered that detailed description on a related art may obscure the points of the present invention, the detailed description will not be provided herein. The preferred embodiments of the present invention will be described in detail hereinafter with reference to the attached drawings.

Figure 1:
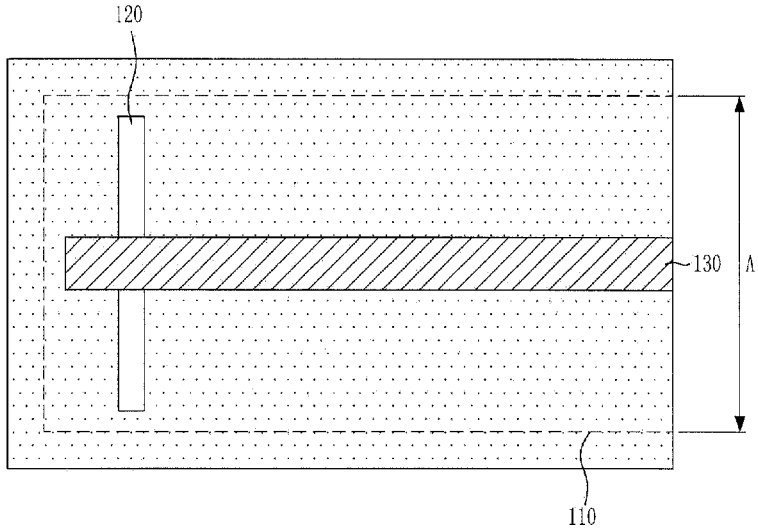
FIG. 1 (PRIOR ART)
FIG. 1 is a plan view illustrating an apparatus for transitioning a millimeter wave between a standard waveguide and a transmission line according to related art.
Figure 2:
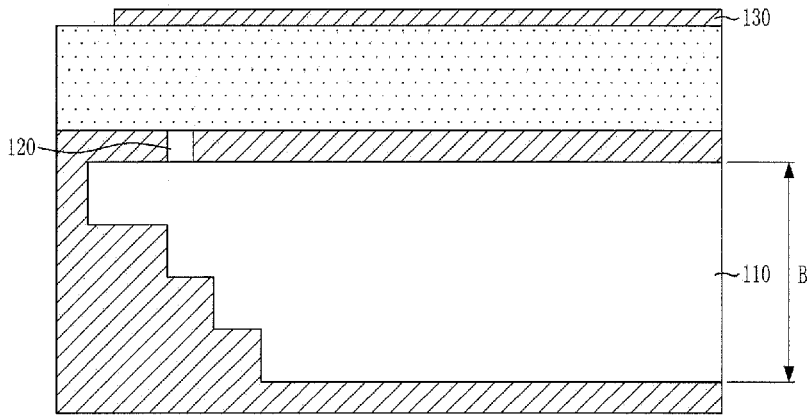
FIG. 2 (PRIOR ART)
FIG. 2 is a cross-sectional view illustrating the apparatus of FIG. 1.
Figure 3:
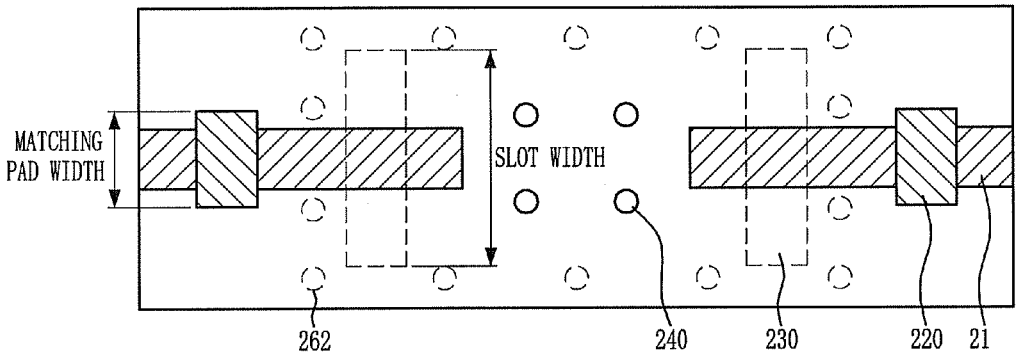
FIG. 3 is a plan view illustrating an apparatus for transitioning a millimeter wave between a dielectric waveguide and a transmission line in accordance with an embodiment of the present invention.
Figure 4:
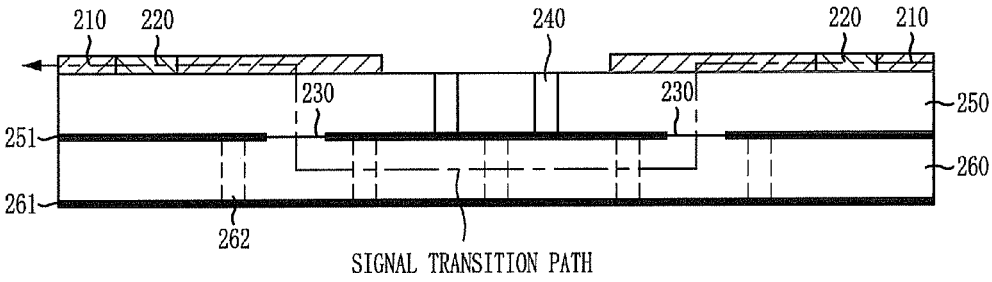
FIG. 4 is a cross-sectional view illustrating the millimeter-wave transition apparatus of FIG. 3.

FIG. 3 is a plan view illustrating an apparatus for transitioning a millimeter wave between a dielectric waveguide and a transmission line in accordance with an embodiment of the present invention, and FIG. 4 is a cross-sectional view illustrating the millimeter-wave transition apparatus of FIG. 3.

Referring to FIGS. 3 and 4, the millimeter-wave transition apparatus includes transmission lines 210, matching pads 220, slots 230, middle vias 240, a first dielectric substrate 250, a second dielectric substrate 260, a first ground surface 251, a second ground surface 261, and vias 262.

The millimeter-wave transition apparatus may be formed of at least one dielectric substrate. In the current embodiment of the present invention, the millimeter-wave transition apparatus includes the first dielectric substrate 250 and the second dielectric substrate 260 formed under the first dielectric substrate 250 as shown in FIG. 4.

The first ground surface 251 is formed between the first dielectric substrate 250 and the second dielectric substrate 260. The second ground surface 261 is formed under the second dielectric substrate 260.

In the current embodiment, a pair of transmission lines 210, a pair of matching pads 220, and a pair of slots 230 are disposed at left and right sides of the middle vias 240 to form an signal input terminal and a signal output terminal.

Particularly, the millimeter-wave transition apparatus includes a dielectric waveguide formed in the second dielectric substrate 260. The dielectric waveguide is formed in a signal transition direction. In detail, the dielectric waveguide is formed using a via array defined by the first ground surface 251, the second ground surface 261, and the vias 262. The vias 262 are arranged in the signal transition direction to form the via array, and the via array functions as a barrier forming a signal transition path.

In the millimeter-wave transition apparatus, the transmission lines 210 formed on the first dielectric substrate 250, i.e., an upper layer, are connected to the dielectric waveguide formed in the second dielectric substrate 260 through the slots 230. The transmission lines 210 are matched with the dielectric waveguide using the matching pads 220.

Hereinafter, elements of the millimeter-wave transition apparatus will be described in more detail.

The transmission lines 210 are disposed on the first dielectric substrate 250 in a signal transition direction. In detail, the transmission lines 210 are connected to external ports so that an input signal can transition from the input terminal to the dielectric waveguide, and an output signal can transition to the output terminal from the dielectric waveguide.

The transmission lines 210 can be formed of microstrips, coplanar waveguides (CPWs), or striplines. In the embodiment of FIGS. 3 and 4, the transmission lines 210 are formed of microstrips, and in the embodiment of FIGS. 7 and 8, the transmission lines 210 are formed of CPWs 410.

The matching pads 220 are disposed in the middle of the transmission lines 210, respectively. The matching pads 220 have a predetermined shape for matching between the transmission lines 210 disposed on the first dielectric substrate 250 and the dielectric waveguide formed in the second dielectric substrate 260.

The slots 230 are formed in the first ground surface 251 in a straight shape. The slots 230 are connected between the transmission lines 210 disposed on the first dielectric substrate 250 and the dielectric waveguide formed in the second dielectric substrate 260 so as to transition signals. Since the slots 230 connect the transmission lines 210 and the dielectric waveguide, signals can transition from the transmission line 210 of the input terminal to the transmission line 210 of the output terminal through the dielectric waveguide.

The middle vias 240 are formed through the first dielectric substrate 250 and connected perpendicular to the first ground surface 251. The middle vias 240 and the vias 262 are arranged in a predetermined pattern. For example, the middle vias 240 are perpendicular to distal ends of the transmission lines 210.

Owing to the middle vias 240, signals are not allow to transition from the input terminal to the output terminal through the first dielectric substrate 250. Furthermore, matching characteristics between the transmission lines 210 and the dielectric waveguide can be improved by adjusting the lengths of the middle vias 240.

As described above, the dielectric waveguide functions as a signal transition path between the input terminal and the output terminal.

In the current embodiment of the present invention, the width of the dielectric waveguide is determined according to the permittivity of the second dielectric substrate 260 based on the size of a standard waveguide, i.e., a standard rectangular waveguide. Meanwhile, the size of the standard waveguide is determined based on an operational frequency. For example, when the operational frequency of a WR-15 standard rectangular waveguide is 60 GHz, the WR-15 standard waveguide may have a size of a 3.8 mm×1.9 mm.

The dielectric waveguide can be designed based on a standard waveguide that is hollow and filled with air, for example, based on the following Equation 1.

$$\lambda_g=2\pi/\beta=2\pi/\sqrt{\kappa^2-\kappa_c^2} \quad \text{Eq. 1}$$

where $\lambda_g$ denotes waveguide wavelength;

$\beta$ denotes propagation constant;

$\kappa$ denotes mater wavenumber; and $\kappa_c$ denotes cutoff frequency.

More specifically, $\kappa$ is $\sqrt{\mu\epsilon}$, and $\kappa_c$ is $\sqrt{(m\pi/a)^2+(n\pi/b)^2}$ where m and n denote waveguide modes. In millimeter waves having a high frequency band from 30 GHz to 300 GHz, $\kappa$ is much larger than $\kappa_c$ ($\kappa>>\kappa_c$).

In this case, $\lambda_g$ is inversely proportional to $\sqrt{\epsilon_r}$, where $\epsilon_r$ denotes permittivity of a dielectric substrate.

As explained above, the dielectric waveguide can be designed based on a standard waveguide. For example, the dielectric waveguide can be designed based on a hollow, air-filled waveguide using Eq. 1 by reducing the size of the standard hollow, air-filled waveguide by a ratio of $1/\sqrt{\epsilon_r}$.

For example, a WR-15 standard waveguide generally has a size of 3.8 mm×1.9 mm. In this case, the dielectric waveguide can be formed in a dielectric substrate having a permittivity of 5.9 by reducing the size of the standard waveguide by a ratio of $1/\sqrt{\epsilon_r}$, such that the dielectric waveguide may have a size of 1.56 mm ($3.8/\sqrt{5.9}$)×0.78 mm ($1.9/\sqrt{5.9}$).

Since the dielectric waveguide uses a waveguide filer operating in TE10 mode, the performance of the dielectric waveguide is almost the same as that of the standard waveguide although there is a little loss due to the variation in height. The height of the dielectric waveguide has a little influence on the performance of the dielectric waveguide.

However, the height of the dielectric waveguide has an influence on the operating frequency and matching characteristics of the dielectric waveguide (the height of the dielectric waveguide is a variable determining the internal impedance of the dielectric waveguide), such that the height of the dielectric waveguide is considered when the transition structure of the dielectric waveguide is designed.

In general, the heights of the dielectric waveguide and the transmission lines 210 are preset. Therefore, the operating frequency and matching characteristics of the millimeter-wave transition apparatus are determined by the structures of the matching pads 220, the slots 230, and the middle vias 240.

To be specific, the operating frequency is determined by the length and width of the slots 230, and the operating frequency bandwidth and performance of the millimeter-wave transition apparatus are determined by the length and width of the matching pads 220 and locations of the middle vias 240.

Therefore, losses and manufacturing errors that can occur in a conventional millimeter-wave transition apparatus having a complicated structure can be eliminated in accordance with the present invention. Furthermore, owing to the simple structure of the millimeter-wave transition apparatus of the present invention, designing time can be saved.

For example, a designer can adjust the length and width of the slots 230 to determine a low-loss operating frequency beforehand. Thereafter, the designer can adjust the length and width of the matching pads 220 so as to reduce a reflection loss below a desired level.

Then, the designer can arrange the middle vias 240 in the first dielectric substrate 250 to prevent transmission of a signal through the first dielectric substrate 250. In addition, the designer can adjust the length of the middle vias 240 for improving matching characteristics.

Figure 5:
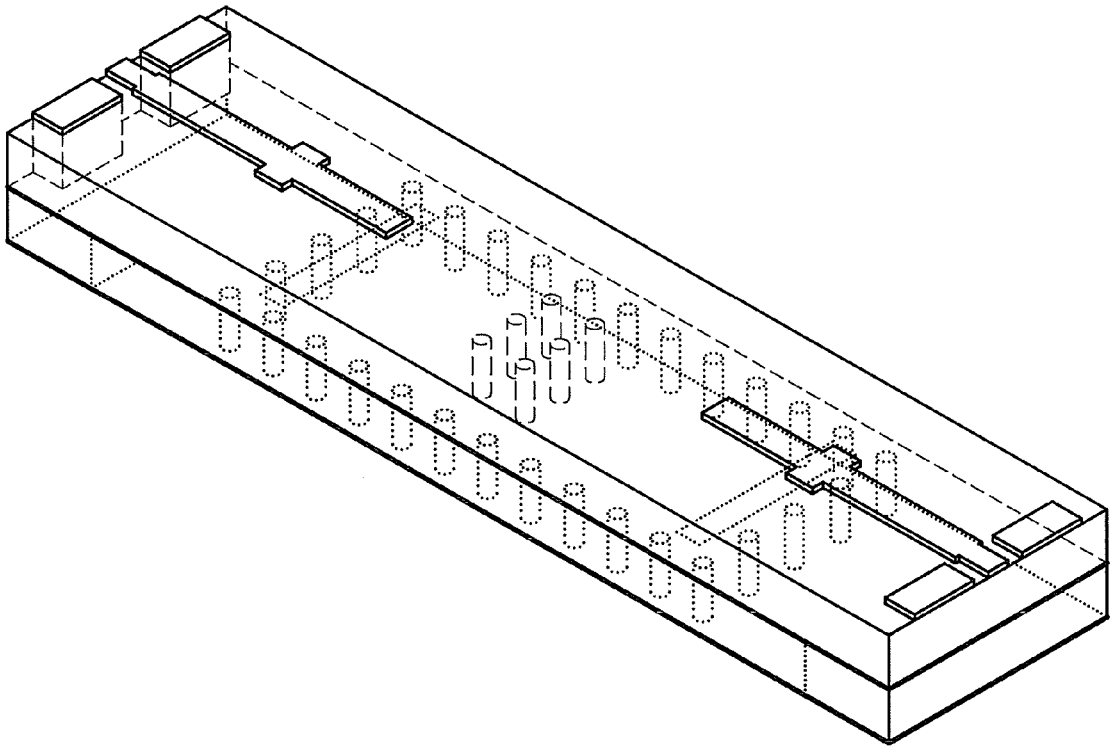
FIG. 5 is a three-dimensional simulation view illustrating the millimeter-wave transition apparatus of FIGS. 3 and 4.
Figure 6:
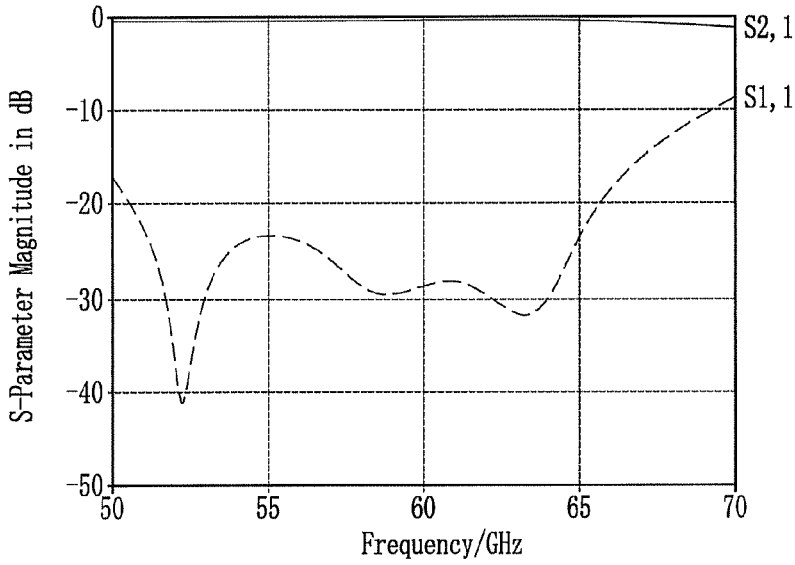
FIG. 6 is a graph illustrating an s-parameter of the millimeter-wave transition apparatus of FIG. 5.

FIG. 5 is a three-dimensional simulation view illustrating the millimeter-wave transition apparatus of FIGS. 3 and 4 in accordance with an embodiment of the present invention, and FIG. 6 is a graph illustrating an s-parameter of the millimeter-wave transition apparatus of FIG. 5. In the simulation of FIG. 5, the permittivity of a dielectric substrate is set to 5.9, the height of the dielectric waveguide is set to 200 μm, and the height of microstrips (i.e., transmission lines 210) is set to 200 μm.

Referring to FIG. 6, s-parameter matching allows a reflection loss to range below −20 dB in a bandwidth of 15 GHz.

Figure 7:
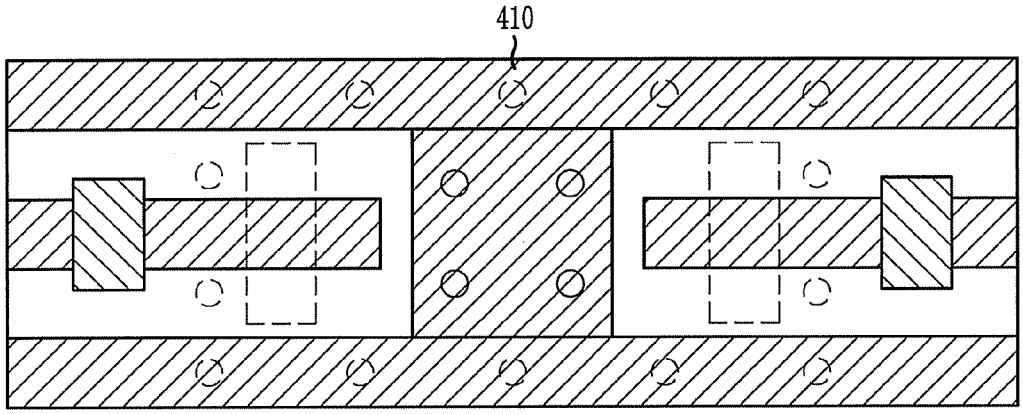
FIG. 7 is a plan view illustrating an apparatus for transitioning a millimeter wave between a dielectric waveguide and a transmission line in accordance with another embodiment of the present invention.
Figure 8:
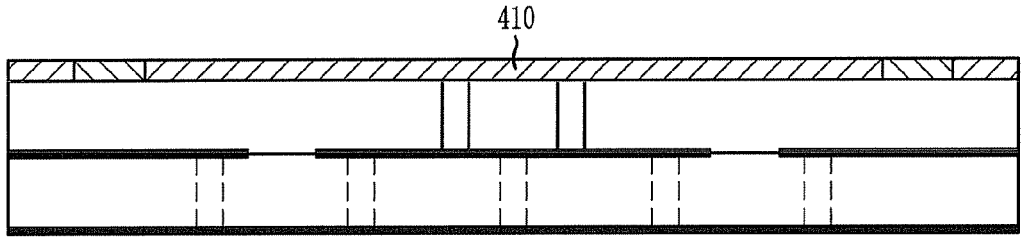
FIG. 8 is a cross-sectional view illustrating the millimeter-wave transition apparatus of FIG. 7.

FIG. 7 is a plan view illustrating an apparatus for transitioning a millimeter wave between a dielectric waveguide and a transmission line in accordance with another embodiment of the present invention, and FIG. 8 is a cross-sectional view illustrating the millimeter-wave transition apparatus of FIG. 7. In the current embodiment of the present invention, a CPW 410 is used as a transmission line.

In accordance with the present invention, microstrips can be used as transmission lines as shown in FIGS. 3 and 4, or the CPW 410 can be used as a transmission line as shown in FIGS. 7 and 8.

Since the millimeter-wave transition apparatus of FIGS. 3 and 4 is described in detail, a detailed description of the millimeter-wave transition apparatus of FIGS. 7 and 8 will be omitted.

As described above, the technology of the present invention can be realized as a program and stored in a computer-readable recording medium, such as CD-ROM, RAM, ROM, floppy disk, hard disk and magneto-optical disk. Since the process can be easily implemented by those skilled in the art of the present invention, further description will not be provided herein.

The present application contains subject matter related to Korean Patent Application Nos. 10-2006-0114045 and 10-2007-0078569, filed in the Korean Intellectual Property Office on Nov. 17, 2006, and Aug. 6, 2007, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. An apparatus for transitioning a millimeter wave, comprising:

transmission lines disposed respectively at input and output terminals on an uppermost dielectric substrate in a signal transition direction and adapted to transition a signal;

a dielectric waveguide formed by a via array disposed between top and bottom ground surfaces of a lowermost dielectric substrate in the signal transition direction as a signal transition path; and slots disposed at a signal transition path of an upper ground surface of each dielectric substrate to connect the transmission lines to the dielectric waveguide so as to transition a signal from the transmission line of the input terminal to the transmission line of the output terminal through the dielectric waveguide.

2. The apparatus of claim 1, wherein the dielectric waveguide has a width determined according to a permittivity of the lowermost dielectric substrates based on a size of a standard waveguide.

3. The apparatus of claim 2, wherein the dielectric waveguide has a size obtained by reducing the size of the standard waveguide by a ratio of $1/\sqrt{\in_r}$ where $\in_r$ is the permittivity of the lowermost dielectric substrate.

4. The apparatus of claim 2, wherein the dielectric waveguide has an operating frequency determined by a width and a length of the slots.

5. The apparatus of claim 1, wherein the apparatus has a two-layer stack structure formed by the dielectric substrates.

6. The apparatus of claim 1, further comprising matching pads having a predetermined shape and disposed respectively at the transmission lines for matching between the dielectric waveguide and the transmission lines.

7. The apparatus of claim 6, wherein the matching pads have a rectangular shape.

8. The apparatus of claim 6, further comprising middle vias arranged in a predetermined pattern between mutually facing ends of the transmission lines, wherein the middle vias are formed through the uppermost dielectric substrate and extend until the middle vias meet the top ground surface of the lowermost dielectric substrate.

9. The apparatus of claim 8, wherein the dielectric waveguide has an operating frequency bandwidth and a performance that are determined by a length and a width of the matching pads and locations of the middle vias.

* * * * *